US007213970B1

(12) United States Patent
Reicin et al.

(10) Patent No.: US 7,213,970 B1
(45) Date of Patent: May 8, 2007

(54) FLEXIBLE STORAGE TANK

(75) Inventors: Edward Reicin, Skokie, IL (US); Jack Moreland, Crete, IL (US)

(73) Assignee: MPC Containment Systems, Ltd., Chicago, IL (US)

( * ) Notice: Subject to any disclaimer, the term of this patent is extended or adjusted under 35 U.S.C. 154(b) by 530 days.

(21) Appl. No.: 10/718,365

(22) Filed: Nov. 20, 2003

Related U.S. Application Data

(63) Continuation of application No. 10/377,382, filed on Feb. 28, 2003, now abandoned.

(60) Provisional application No. 60/360,673, filed on Mar. 1, 2002.

(51) Int. Cl.
*B65D 30/00* (2006.01)
*B65D 33/00* (2006.01)

(52) U.S. Cl. ..... 383/107; 383/105; 383/903

(58) Field of Classification Search ..... 383/105, 383/903, 3, 107; 446/220; 441/30, 40, 66, 441/129; 5/706, 655.4, 655.5, 413 AM; 472/129, 134
See application file for complete search history.

(56) References Cited

U.S. PATENT DOCUMENTS

| | | | | |
|---|---|---|---|---|
| 2,696,235 | A | 12/1954 | Toffolon | |
| 2,724,418 | A | 11/1955 | Krupp | |
| 3,068,561 | A * | 12/1962 | Jones | 29/401.1 |
| 3,416,762 | A | 12/1968 | Headrick | |
| 3,453,164 | A | 7/1969 | Gursky et al. | |
| 3,919,030 | A | 11/1975 | Jones | |
| 3,978,901 | A | 9/1976 | Jones | |
| 4,174,245 | A | 11/1979 | Martineau | |
| 4,247,678 | A | 1/1981 | Chung | |
| 4,434,712 | A * | 3/1984 | Ross et al. | 99/646 S |
| 4,441,627 | A * | 4/1984 | Takeuchi | 383/4 |
| 4,487,913 | A | 12/1984 | Chung | |
| 4,573,508 | A | 3/1986 | Knaus | |
| 4,668,535 | A | 5/1987 | Liggett et al. | |
| 4,854,481 | A | 8/1989 | Bohl et al. | |
| 4,865,096 | A | 9/1989 | Schober et al. | |
| 5,047,495 | A | 9/1991 | Kolycheck | |
| 5,188,460 | A * | 2/1993 | Dorse | 383/18 |
| 5,199,793 | A | 4/1993 | Jackson | |
| 5,368,395 | A | 11/1994 | Crimmins | |
| 5,499,743 | A | 3/1996 | Blumenkron | |

(Continued)

OTHER PUBLICATIONS

Sulzer Technical Review, Jan. 1995.

*Primary Examiner*—Jes F. Pascua
(74) *Attorney, Agent, or Firm*—Michael Best & Friedrich LLP

(57) ABSTRACT

A soft shell, flexible storage tank is provided, including corners of an improved configuration adapted to resist leaks. The walls of the tank and the corners are relatively more rounded and larger in radius than those of conventional flexible tanks. The walls and the improved corners act together to resist leaks. The rounded corners tend to reduce the effective pressure in the tank walls by loading the seams predominantly in shearing stress when the tank is filled with a liquid. The rounded corners are developed as panels, which are thermally bonded to produce secure and reliable liquid-tight seams. Each of the panels is bonded by lapped seams to others of the panels. Each of the rounded corners includes a generally triangular corner that is bonded to at least three other panels. In effect, the flexible storage tank functions as a pressure vessel, which tends to resist leakage.

9 Claims, 8 Drawing Sheets

U.S. PATENT DOCUMENTS 5,626,313 A 5/1997 Davis
5,755,425 A 5/1998 Marolda
5,967,370 A 10/1999 Nettles et al.
6,101,964 A 8/2000 Lesesne
6,186,701 B1 * 2/2001 Kempers ..... 405/19
6,315,233 B1 11/2001 Van Wingerden
6,908,223 B2 * 6/2005 Bibbo et al. ..... 366/333

* cited by examiner

FLEXIBLE STORAGE TANK

CROSS-REFERENCE TO RELATED PATENT APPLICATIONS

This patent application is a continuation of U.S. patent application Ser. No. 10/377,382, filed Feb. 28, 2003 now abandoned, which claims the benefit of U.S. Provisional Patent Application No. 60/360,673, filed Mar. 1, 2002.

FIELD OF THE INVENTION

The invention relates to a lightweight storage tank for fluids. More specifically, the invention relates to a fabric reinforced, thermoplastic coated, flexible container utilized, for example, for storage of liquid fuel, potable water or liquid hazardous waste.

BACKGROUND OF THE INVENTION

Flexible liquid storage tanks of relatively high capacity that exhibit a pillow- or sausage-like shape when filled are widely known as "pillow tanks." They are typically composed of thermoplastic materials, such as polyether or polyester, and may include two or more layers of material. These tanks can be used to store, for example, gasoline, diesel fuel, jet fuel, potable water or hazardous liquid waste. Flexible storage tanks have the advantages of light weight and portability. Also, flexible storage tanks can be stored in a relatively small volume until needed.

However, conventional flexible storage tanks typically include seams, which are often the source of leakage. In particular, conventional flexible storage tanks are constructed in shapes that subject the seams of their flexible walls to stresses oriented perpendicularly to the flexible walls. These perpendicular stresses, widely known as "normal stresses," are more difficult to seal against than "shearing stresses" (also known as "tangential stresses").

For example, U.S. Pat. No. 3,453,164, issued to Gursky et al., describes a method of building fabric elastomeric containers in which a fabric is cut into strips and a tube is assembled by overlapping the edges of the strips in stitching to form individual seams. A liquid polyurethane reaction mixture and a material suitable for forming a fuel vapor barrier are applied to both sides of the assembled tube. Two end members are formed by folding pieces of the fabric into U-shapes. One of the U-shaped end members is cemented on each end of the tube to form a substantially rectangular container. Then each of the corners is trimmed to remove a triangle of fabric from each corner. Specially shaped and sized pieces of knit fabric are cemented over the trimmed areas to produce somewhat rounded corners, as indicated for knit fabric piece 41 in FIG. 4 of the Gursky et al. patent. However, as can be seen in FIG. 5 of the Gursky et al. patent, the finished container is still substantially rectangular in shape. Because neither this substantially rectangular shape nor the shape of fabric piece 41 matches the configuration of hydraulic forces within the container when it is filled with a liquid, at least some of the seams in the container of Gursky et al. patent are likely to be exposed to predominantly normal stresses.

A collapsible storage tank is described in U.S. Pat. No. 4,573,508, issued to Knaus, as including a substantially rectangular tank body composed of vulcanized inner and outer envelope structures. As can be seen in FIG. 3 of the Knaus patent, the collapsible storage tank includes rectangular corners and a peripheral seam that do not conform to the configuration of hydraulic forces that arise when the collapsible storage tank is filled with a liquid.

U.S. Pat. No. 3,919,030, issued to Jones, describes an elastic, fluid impervious storage tank having an intermediate section and a pair of end sections. Each of the end sections is reportedly formed from a single blank composed of a fiber-reinforced elastomer, which is cut and folded so that the corner portions are of rounded or arcuate configuration. The Jones et al. patent recites that this rounded corner portion greatly increases the strength of the storage tank, as compared to tanks having angular corner portions. According to the Jones patent, the cuts in the end section are closed by adhering a pre-formed arcuate inner attachment member 36 to the inside surface of the corner portion and, also adhering a pre-formed arcuate outer attachment 37 to the outer surface of each corner portion. The need to employ pre-formed members 36, 37 is a disadvantage in some situations. Also, it appears that any advantages associated with the storage tank of the Jones patent are limited to storage tanks that are small enough for the end sections to be constructed from one or two blanks of fabric material. Relatively larger tanks, which must necessarily be constructed of a number of fabric panels, are excluded.

A need exists for an improved flexible storage tank constructed in a configuration that is less susceptible to leaking when constructed of commonly available materials. Preferably, the improved tank is formed in shapes of revolution having relatively greater radii, as compared to conventional flexible storage tanks. Ideally, the seams of the improved tank are substantially under shearing stress, rather than normal stress, when the tank is filled with a liquid.

BRIEF SUMMARY OF THE INVENTION

The invention provides a soft shell, flexible storage tank, including corners of an improved configuration adapted to resist leaks. The corners are relatively more rounded and larger than those of conventional flexible tanks. Additionally, the walls of the tank are fabricated from thermoplastic panels joined in lapped seams by a heat treatment. The walls and the improved corners act together to resist leaks. The rounded corners tend to reduce the effective pressure in the tank walls by loading the seams predominantly in shearing stress when the tank is filled with a liquid.

The tank is especially resistant to leaks which might otherwise occur in the seams and adjacent the ends and corners of the tank. The tank is configured in relatively large-radius shapes of revolution which tend to place the seams in shearing stress, as opposed to normal stress. The shapes of revolution are developed as panels, which are thermally bonded to produce secure and reliable liquid-tight seams. Each of the panels is bonded by lapped seams to others of the panels.

In developing the panels, allowance may be made for panel stretching under the influence of gravity and hydraulic pressure, over a specific range of ambient temperature and storage fluid density. The total number of panels and length of seams are other factors to consider.

The tank is unique in that it includes specially rounded corners, sometimes called "elegant corners." In effect, the flexible storage tank functions as a pressure vessel, which tends to resist leakage. Each of the rounded corners includes four panels. One of the four panels is generally triangular, being bounded by three curved edges. Each of the curved edges is bonded by a lapped seam with one of the four panels. The rounded corner is generally ellipsoidal when the tank is filled with a liquid.

The tanks are formed from panels composed of thermoplastic material. The panels are sealed, effectively welded together, by an application of heat. Flexible urethane material is used for the tank, preferably polyether or polyester, most preferably polyether. Additionally, the edges of the panels are filled up with a film of rubber gum to further reduce leakage. The resulting seams are superior to conventional seams that have previously been created by use of glue or solvents. The tanks are suitable for use with water and aromatic storage liquids.

The corners of the tank are built-up by joining thermoplastic panels. While this may increase the time required to make the tank, the improved rounded corners reduce the effect of pressure from liquid that occurs in the corners of the tank. This reduces the possibility of leakage. The elegant corner does not concentrate stress at any point in the corner.

In order to make a flexible storage tank of the present invention, one or more sheets composed essentially of a thermoplastic material and a fabric layer are cut to produce panels of various shapes. A number of top panels of approximately equal length and generally rectangular shape are produced in this manner. Bottoms panels of approximately the same length as the top panels and generally rectangular shape are also fashioned from one or more sheets. Side panels are cut to a length less than that of the top panels and the bottom panels. Generally triangular panels are shaped so as to be bounded by three curved edges.

These panels are assembled by bonding the top panels to each other to produce a generally rectangular topside assembly. The bottom panels are bonded to each other to each other to produce a generally rectangular bottomside assembly. Each of the ends of the top panels is bonded, respectively, with one of the ends of the bottom panels. The triangular panels are attached by a lapped seam bonding each of the curved edges with one of the top panels, one of the bottom panels or one of the side panels to produce a flexible storage tank having rounded corners.

Previously known similar products were called "pillow tanks". They had somewhat rounded corners, but used cement to form the seams and were configured in a different geometry than the tank of the instant invention. They were more prone to leakage than the tanks of the present invention.

The improved tank is made in various sizes. In order to reduce the cost of construction, the width of the various sizes of tank is fixed and the volume is adjusted by varying the length of the particular tank. In this way, the tank sizes are expandable.

DETAILED DESCRIPTION OF THE INVENTION

In a preferred embodiment, the invention provides a flexible, soft shell, fuel storage tank 100, as depicted in FIGS. 1–15. Tank 100 is useful for containing, for example, diesel fuel or jet fuel and has a capacity of 50,000 United States gallons. Tank 100 is adapted to resist leaks over a range of operating temperature up to about 130 degrees F.

Figure 1:
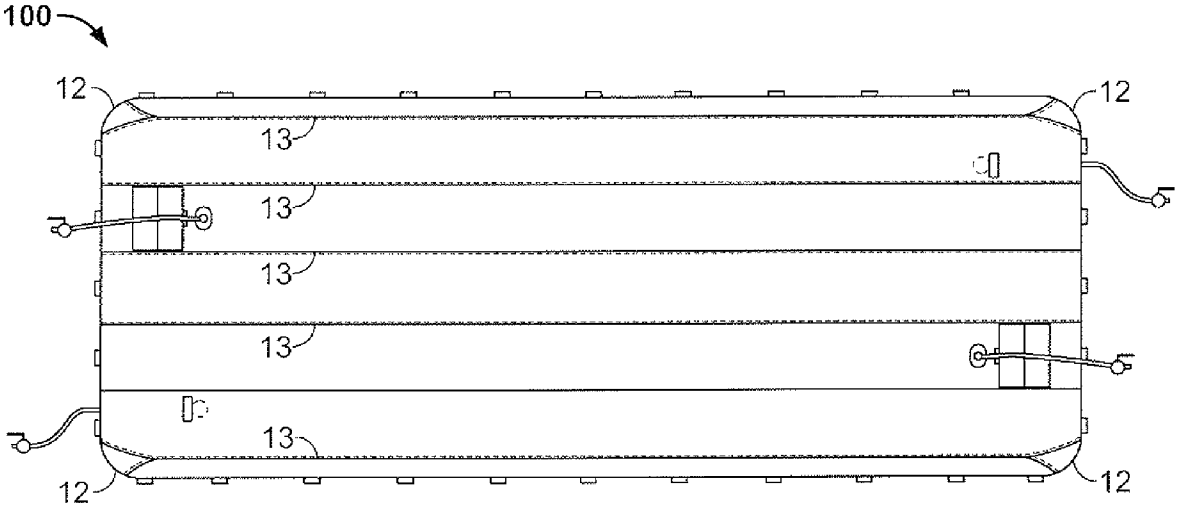
FIG. 1 is a plan view of a 50,000-gallon flexible fuel storage tank 100.

Referring now to FIG. 1, tank 100 is of lapped seam construction with seams 13 extending along the length of tank 100. A "lapped seam," also known as a lapped joint, means a seam made by lapping one piece or part over another and fastening them together. Corners 12 of tank 100 are noticeably rounded, and built-up employing several panels 1–11, 15–18 of definite shape. The improvement afforded by rounded corners 12 is analogous to that found in rounded pressure vessels.

Figure 2:
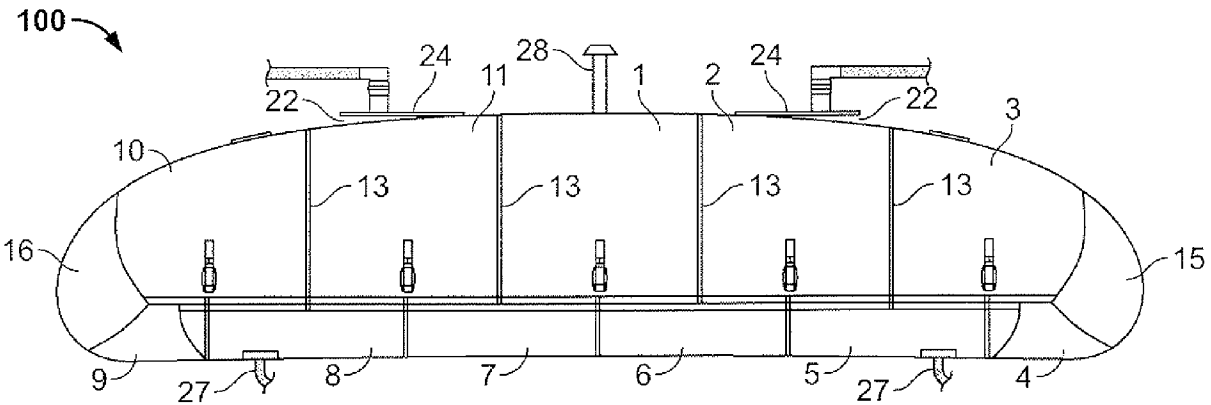
FIG. 2 is an elevation end view of the tank depicted in FIG. 1.

As depicted in FIG. 2, panels 1–11, 15–18 are composed of a layer of thermoplastic material, such as polyester or polyether, and a fabric layer. Other materials may be employed based, among other things, on the physical and chemical characteristics of the liquid intended for storage and the expected operating temperature conditions. Seams 13 of tank 100 are sealed by applying heat to the thermoplastic material. The resulting welded seam 13 is superior to seams formed by applying glues or solvents.

While tank 100 is a 50,000 gallon tank, tanks of other capacities may be easily fashioned by employing the same end dimensions and adjusting the lengths of the respective panels.

Tank 100 is 64½ feet long and 23 feet wide when filled. Tank 100 includes two manways 22 for inspection and cleaning. Each of the manways 22 is located six feet from an end of tank 100. Tank 100 also includes two floor cutouts 24, two floor drains 27 and a vent 28, which is fitted with a flame arrestor (not shown). Filling is accomplished through one or more of the manways 22 via a flexible filler hose of 4 inches diameter.

As shown in FIG. 2, tank 100 has a generally elliptical transverse cross-section, bounded by panels 1–11, 15–18. Panels 1–11 are numbered sequentially beginning at the top center line of tank 100 and proceeding in a clockwise direction, as depicted in FIG. 2. Each of panels 1–11 is symmetrical with regard to a center line that is perpendicular to the length of the respective panel.

Figure 16:
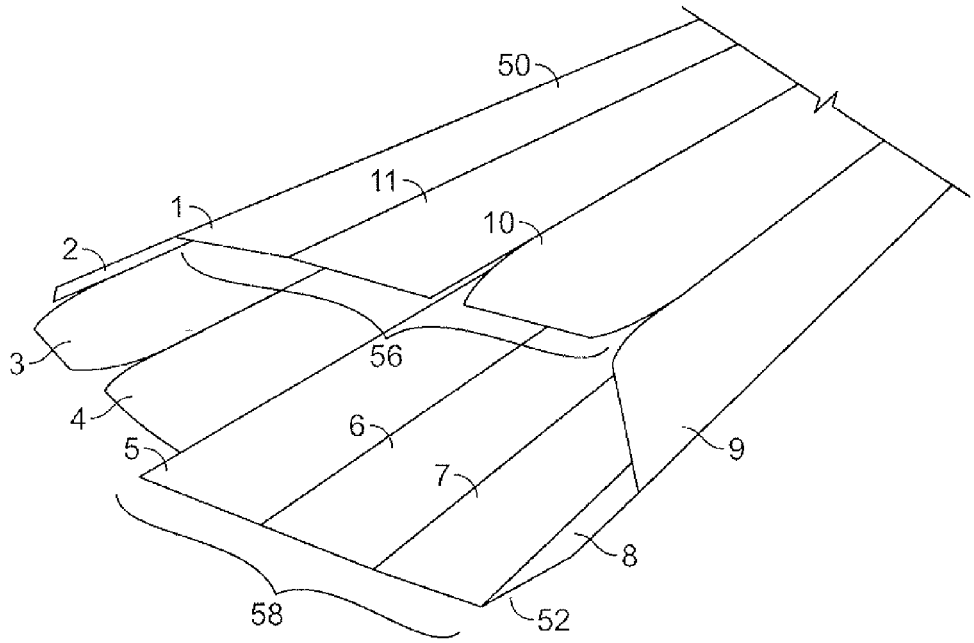
FIG. 16 is a partial perspective view of tube 50 constituted by panels 1–11 according to the invention.

In order to better communicate the invention, panels 1, 2, 3, 10 and 11 are referred to as top panels, together forming topside assembly 56 (best seen in FIG. 16). Top panels 1, 2, 3, 10 and 11, are all between 66 and 67 feet in length, and are about 4 and ½ feet in width, although not all are exactly rectangular. Panels 5–8 are referred to as bottom panels, together forming bottomside assembly 58 (best seen in FIG. 16). Bottom panels 5–8 are all about 65 feet in length, and about 4 and ½ feet in width, although they are exactly rectangular. Panels 4 and 9 are referred to as side panels, each having a length of less than about 60 and a width of about 4 and ½ feet, although they are not exactly rectangular. Joining each of the side panels 4, 9, respectively to topside assembly 56 and to bottomside assembly 58 produces flexible tube 50 (best seen in FIG. 16).

Each of panels 15–18 is generally triangular and bounded by three of curved edges 30–41, as described below. Tank 100 is 5½ feet in height when filled and is provided with thirty-two handles, for use in folding, positioning or securing tank 100.

Figure 3:
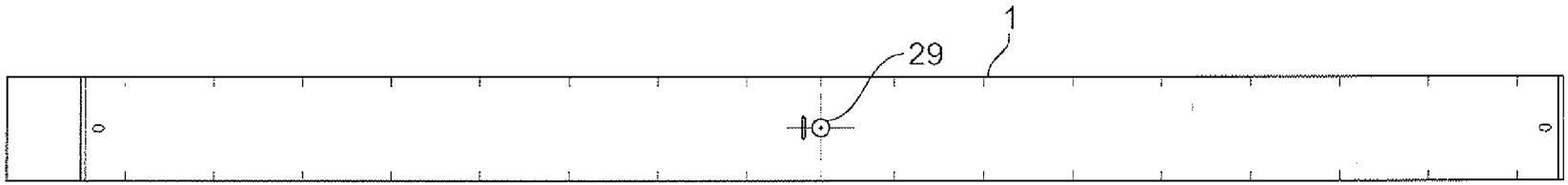
FIG. 3 is a development of panel 1 for the tank depicted in FIG. 1.

FIGS. 3–13 depict developments of panels 1–11, 15–18, which illustrate details for each of panels 1–11, 15–18. Referring to FIG. 3, panel 1 is in the shape of a rectangle 66 feet and 10¼ inches long and 4⅔ feet wide. A 3-inch wide seam area is designated along each end of panel 1. A vent cutout 29 is located at the intersection of the center-lines of rectangular panel 1.

Figure 4:
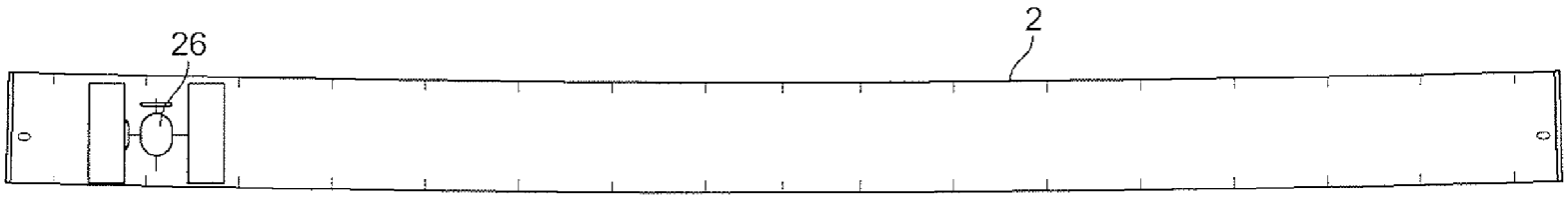
FIG. 4 is a development of panel 2 for the tank depicted in FIG. 1.

As shown in FIG. 4, panel 2 has a generally rectangular, six-sided shape cut from a rectangle 4⅔ feet wide and 66 feet and 10¼ inches long. Panel 2 has one straight edge 66 feet and 5⅝ inches in length. Panel 2 has a second straight edge of length 48 feet and 10½ inches in length, centered on and parallel to the first straight edge at a distance of 4 feet and 8 inches. The ends of panel 2 are slightly obtuse with respect to the first straight edge, each extending from the first straight edge to a terminus located 4 feet and 5¼ inches transversely from the first straight edge and 66 feet and 10¼ inches from the terminus of the opposite end. Two additional straight edges, each measuring 8 feet and 11⅞ inches connect the ends with the second straight edge. A 3-inch wide seam area is designated along each end of panel 2. A manway cutout 26 is located at the intersection of the axial center of panel 2, about six and a half feet from the nearest end.

Figure 5:
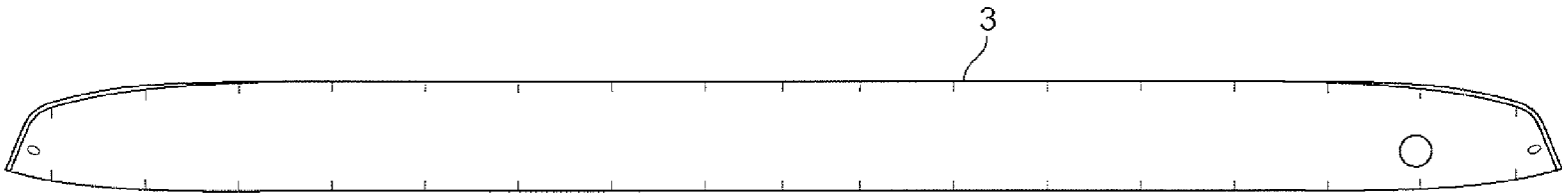
FIG. 5 is a development of panel 3 for the tank depicted in FIG. 1.

FIG. 5 depicts panel 3, which may be cut from a rectangle 66 feet and 4 and 3/16 inches long and 4 feet and 5 and ¼ inches wide. Panel 3 has two centrally located, parallel edges of length 52 feet and 5 and ¾ inches and 48 feet and 3 and ¾ inches, respectively. A seam area 2 and ½ inches wide is designated along the shorter of these parallel edges. Each of the ends of panel 3 is an oblique straight edge having a length of 2 feet and 6 and 15/16 inches. A seam area having a width of 3 inches is designated along each of the straight edge ends of panel 3. The straight edge ends are connected to the parallel edges by curves, as shown in FIG. 5.

Figure 6:
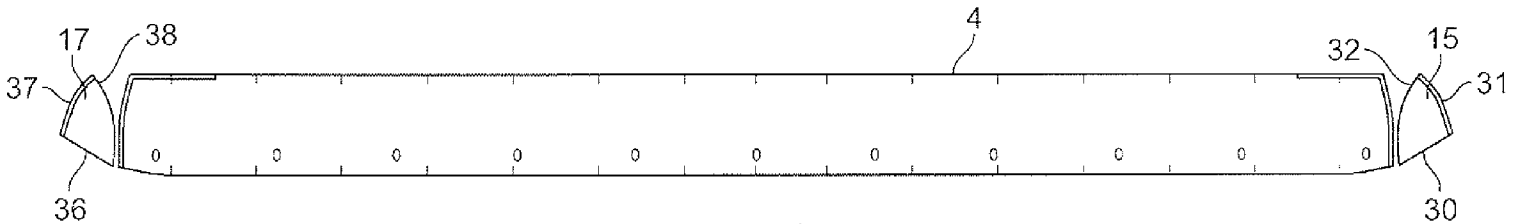
FIG. 6 is a development of panel 4 for the tank depicted in FIG. 1.

Panel 4 and separate triangular panels 15, 17 are depicted in FIG. 6. Panels 4, 15 and 17 are shown together in FIG. 6 to emphasize that all three may be cut from a single rectangular sheet that is 66 feet and 5 inches long and 4 feet and 5 and ¼ inches wide. Panel 4, which is one of the side panels 4, 9, is generally rectangular with an overall length of 59 feet and 8 and ⅞ inches. A seam area having a width of 2 and ½ inches is designated along three of the edges of panel 4.

Continuing with FIG. 6, panels 15 and 17 are mirror images of each other. Each of the panels 15, 17 is generally triangular in shape and bounded by three curved edges. A triangle inscribed within and sharing the vertices of panel 15 would have one altitude of about 2 feet and 4 inches and another altitude of about 4 feet and 3 inches. A seam area 2 and ½ inches wide is designated along intermediate length curved edges 31, 37 of panels 15, 17, respectively.

Figure 7:
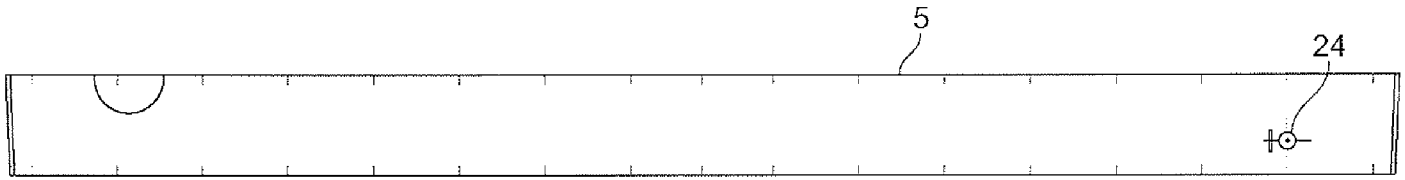
FIG. 7 is a development of panel 5 for the tank depicted in FIG. 1.

As depicted in FIG. 7, panel 5 is generally rectangular with a length of 64 feet and 10 and 13/16 inches and a width of 4 feet and 8 inches. Drain cutout 24 is located 5 and ½ feet from the nearest end.

Figure 8:
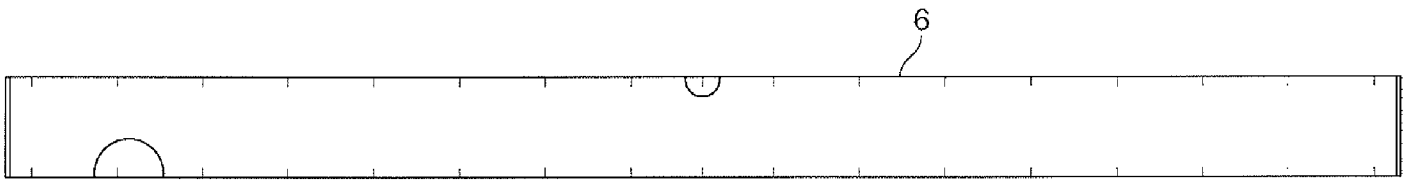
FIG. 8 is a development of panel 6 for the tank depicted in FIG. 1.

Panel 6, shown in FIG. 8, is generally rectangular with a length of about 64 feet and 10 and ½ inches and a width 4 feet and 8 inches.

Figure 9:
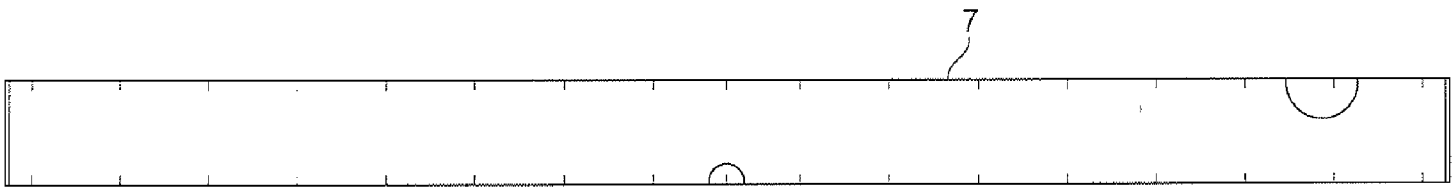
FIG. 9 is a development of panel 7 for the tank depicted in FIG. 1.

Panel 7, which is depicted in FIG. 9, is the mirror image of panel 6.

Figure 10:
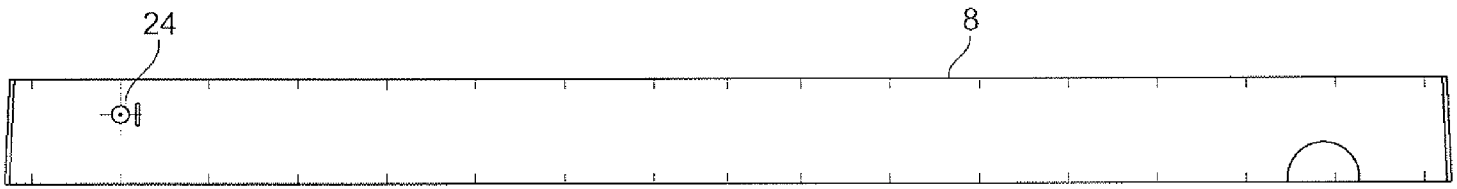
FIG. 10 is a development of panel 8 for the tank depicted in FIG. 1.

Panel 8, which is depicted in FIG. 10, is the mirror image of panel 5.

Figure 11:
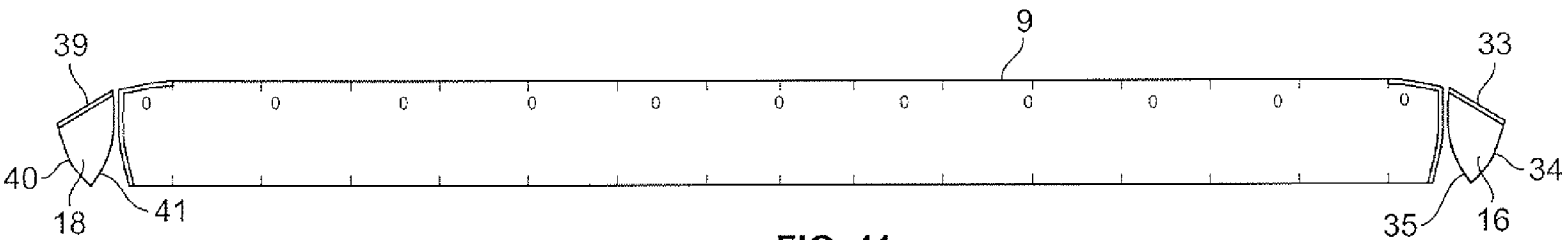
FIG. 11 is a development of panel 9 for the tank depicted in FIG. 1.
Figure 12:
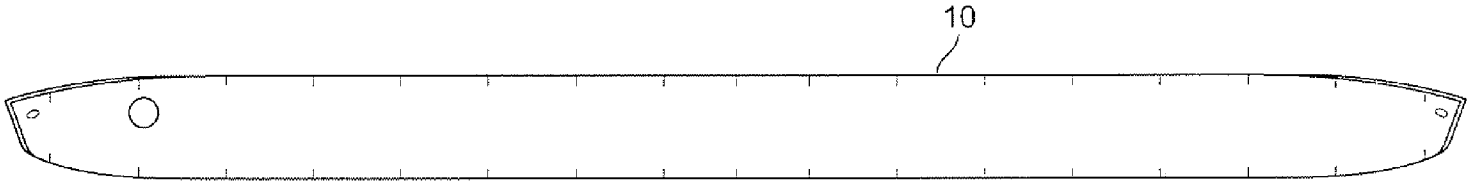
FIG. 12 is a development of panel 10 for the tank depicted in FIG. 1.

Panel 9, which is depicted in FIG. 11, is the mirror image of panel 4. Panels 16 and 17, which are also depicted in FIG. 11, are the mirror images of panels 15 and 17, respectively Panel 10, which is depicted in FIG. 12, is the mirror image of panel 3.

Figure 13:
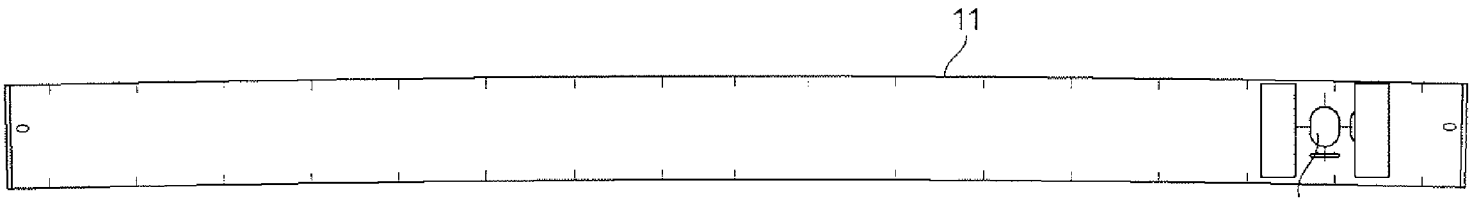
FIG. 13 is a development of panel 11 for the tank depicted in FIG. 1.

Panel 11, which is depicted in FIG. 13, is the mirror image of panel 2.

Figure 14:
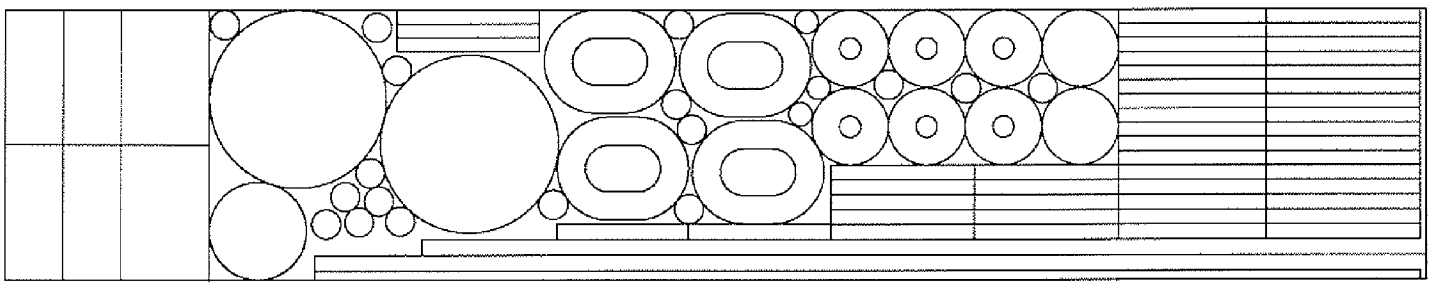
FIG. 14 is a development of accessories for the tank depicted in FIG. 1.

FIG. 14 illustrates accessory panels, which may be optionally be used in constructing tank 100. For example, the legend "MW CHAF 37" in FIG. 14 designates a chafing pad to be located directly beneath one of the manways 22.

Figure 15:
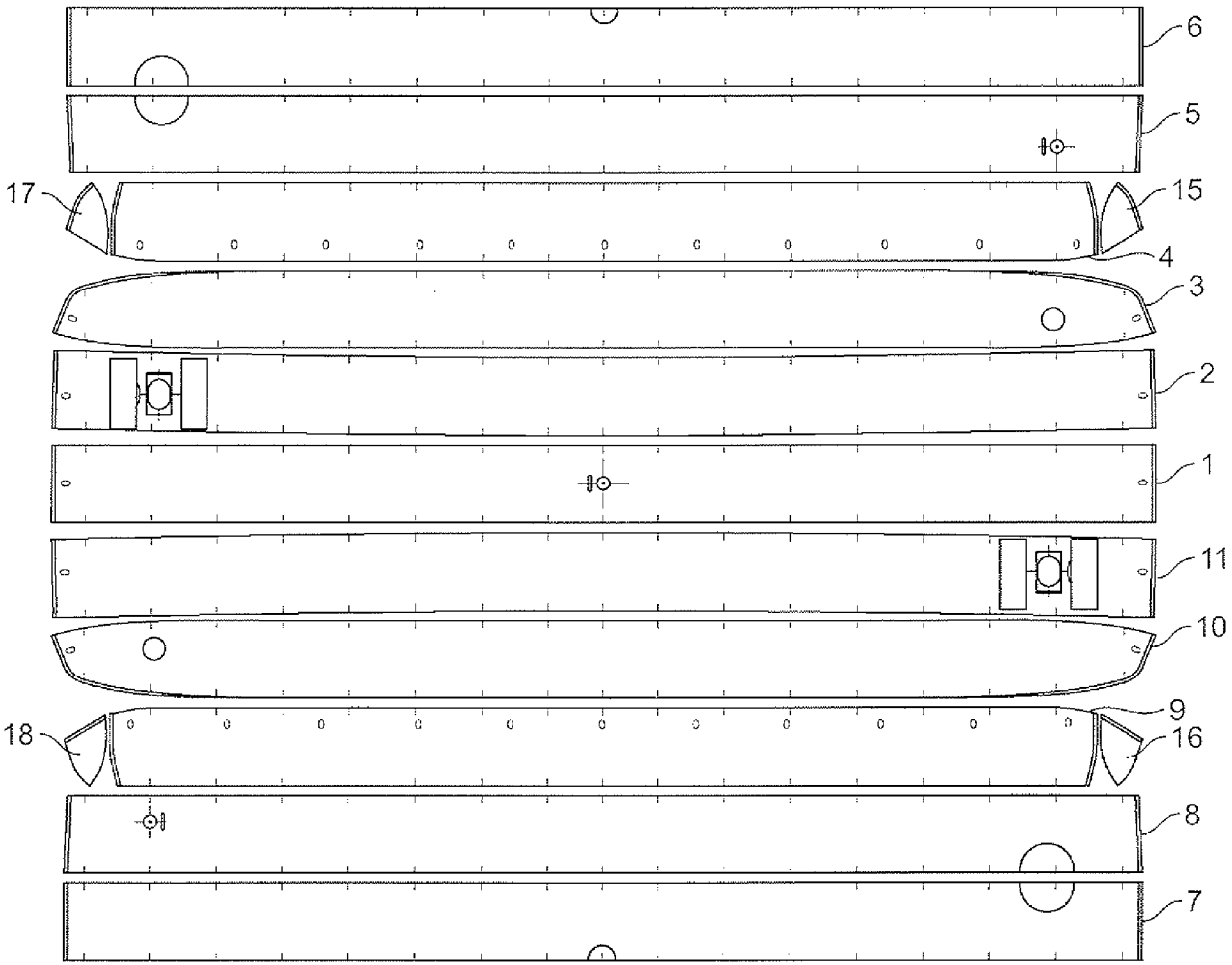
FIG. 15 is an assembly drawing for the tank depicted in FIG. 1.

FIG. 15 is an assembly drawing, which depicts the manner in which panels 1–11 are joined with regard to each other. More specifically, a preferred method of making tank 100 includes joining each of panels 1–11 to two others of panels 1–11 by thermally bonded. lapped seams 13 in the relationship illustrated in FIG. 15. Seams 13 may be bonded in any order; preferably, panels 6 and panel 7 are the last of this group to be bonded.

Bonding panels 1–11 along their edges produces tube 50, as depicted in FIG. 16. Panels 1, 2, 3, 10, and 11, together, constitute topside assembly 56. Panels 5–8, together, constitute bottomside assembly 58. Side panels 4, 9 join the two assemblies 56, 58 to each other. Tube 50 includes end 52, which is shown in FIG. 16, and end 54 (not shown.).

Figure 17:
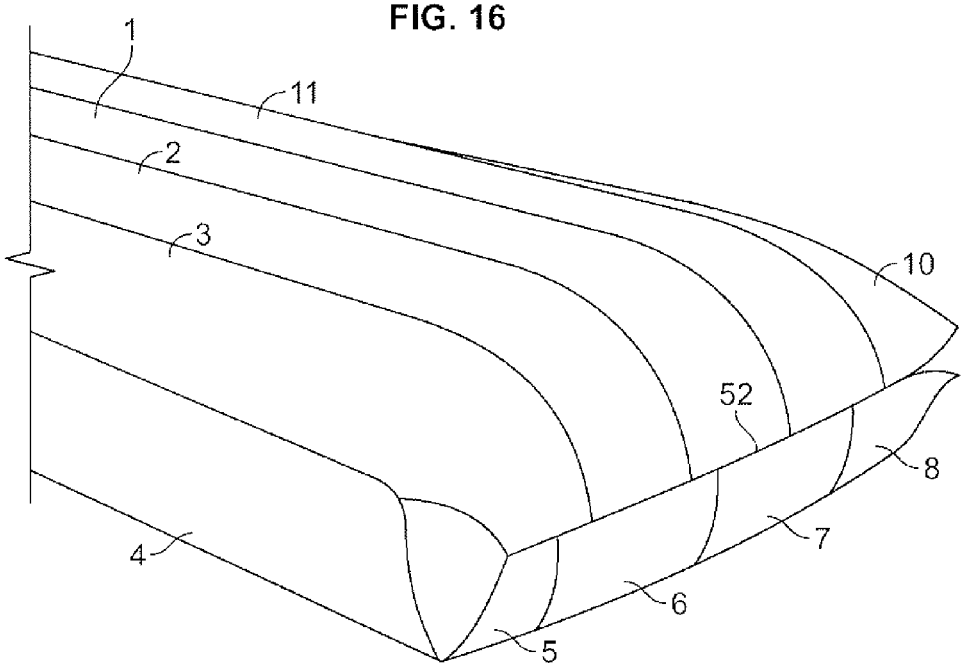
FIG. 17 is a partial perspective view of tube 50 with top panels 1, 2, 3, 10 and 11 and bottom panels 5–8 joined in a closed end.

After tube 50 has been assembled, the ends of top panels 1, 2, 3, 10, and 11 each may be bonded, respectively, with the ends of one of bottom panels 5–8. This bonding substantially closes end 52 of tube 50, as shown in FIG. 17, and end 54 (not shown). However, as can be seen in FIG. 17, openings still remain.

Figure 18:
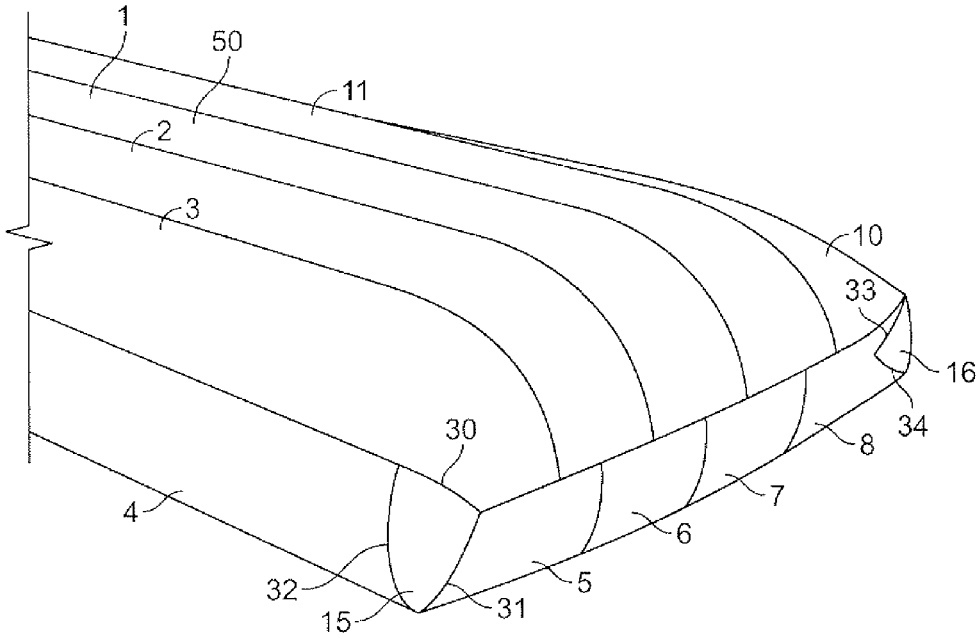
FIG. 18 is a partial perspective view of tank 100 showing the placement of triangular panels 15, 16.
Figure 19:
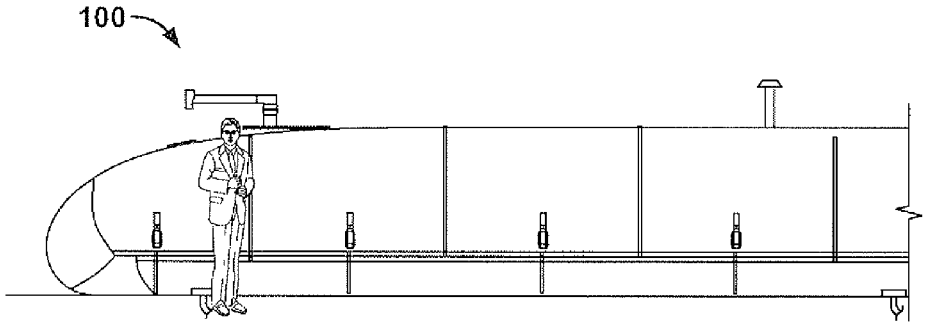
FIG. 19 is a partial side view of tank 100 drawn to scale, with a human figure (not part of the invention) included to convey the size of tank 100.

FIG. 18 depicts triangular panels 15, 16 positioned and bonded to complete the closing of end 52 of tube 50. Triangular panels 17, 18 (best seen in FIG. 11) are similarly positioned and bonded to close end 54 (not shown). Curved edge 30, which is the shortest edge of panel 15, bonds to panel 3. Curved edge 31, which is of intermediate length in panel 15 bonds to panel 5. Curved edge 32, which is the longest edge of panel 15, bonds to panel 4. Each the curved edges 30, 31, 32, respectively, is thermally bonded in a lapped seam 13 with one of panels 3, 5, 4 to complete one of the rounded corners 12.

When assembled, tank 100 comprises 3500 square feet of coated fabric and weighs 1,080 pounds. Because seams 13 of tank 100 are substantially under shearing stress, rather than normal stress, tank 100 tends to resist leakage when filled with a storage liquid.

While only a few, preferred embodiments of the invention have been described above, those of ordinary skill in the art will recognize that these embodiments may be modified and altered without departing from the central spirit and scope of the invention. The preferred embodiments described above are to be considered in all respects as illustrative and not restrictive.

What is claimed is:

1. A flexible storage tank, which comprises:

a plurality of panels, each of the panels bonded by lapped seams with others of the panels to enclose a storage volume; and a plurality of rounded corners, each of the corners including at least four of the panels;

wherein each of the corners includes a generally triangular panel that is bounded by three curved edges, each of the curved edges being bonded by one of the lapped seams with one of the other panels.

2. The flexible storage tank of claim 1, in which each of the panels that is bonded with one of the triangular panels is bonded to two others of the panels that are bonded to the same one of the triangular panels.

3. The flexible storage tank of claim 2, in which each of the panels that is bonded with one of the triangular panels is bonded, respectively, to another of the triangular panels.

4. The flexible storage tank of claim 2, which has a length, and in which the panels extend generally lengthwise, specifically excepting the triangular panels.

5. The flexible storage tank of claim 1, in which each of the corners is generally ellipsoidal when the storage volume contains a liquid for storage.

6. The flexible storage tank of claim 1, in which the lapped seams are predominantly loaded in shearing stress when the storage volume contains a liquid.

7. The flexible storage tank of claim 1, in which one of the panels includes a cutout and is attached to a manway having a removable cover for closing the cutout.

8. The flexible storage tank of claim 1, in which each of the panels is composed of a thermoplastic material and a fabric layer.

9. The flexible storage tank of claim 1, in which each of the panels is thermally bonded by lapped seams with others of the panels.

* * * * *